US011147348B2

(12) United States Patent
Lauper et al.

(10) Patent No.: US 11,147,348 B2
(45) Date of Patent: Oct. 19, 2021

(54) DECORATIVE ELEMENT MADE BY A SETTING TECHNIQUE

(71) Applicant: COMADUR SA, Le Locle (CH)

(72) Inventors: Stéphane Lauper, Cortaillod (CH); Lionel Blaser, Corcelles (CH); Alexandre Netuschill, Le Cerneux-Pequignot (CH)

(73) Assignee: COMADUR SA, Le Locle (CH)

( * ) Notice: Subject to any disclaimer, the term of this patent is extended or adjusted under 35 U.S.C. 154(b) by 0 days.

(21) Appl. No.: 17/111,022

(22) Filed: Dec. 3, 2020

(65) Prior Publication Data

US 2021/0169185 A1 Jun. 10, 2021

(30) Foreign Application Priority Data

Dec. 10, 2019 (EP) ..... 19214649

(51) Int. Cl.
*A44C 17/02* (2006.01)

(52) U.S. Cl.
CPC ..... *A44C 17/02* (2013.01)

(58) Field of Classification Search
CPC . A44C 17/02; A44C 17/0208; A44C 17/0216; A44C 17/0225; A44C 17/04; G04B 39/00; G04B 45/0076; G04B 47/042
USPC ..... 368/285
See application file for complete search history.

(56) References Cited

U.S. PATENT DOCUMENTS 4,972,685 A * 11/1990 Poll ..... A44C 17/02 63/26
6,491,424 B1 * 12/2002 Tardy ..... G04B 39/00 368/283
2005/0006566 A1 1/2005 Maeda
2014/0075990 A1 * 3/2014 Botha ..... A44C 27/008 63/26
2015/0121959 A1 * 5/2015 Huynh ..... A44C 17/04 63/28
2017/0231336 A1 * 8/2017 Disinger ..... A44C 17/007 63/1.13

(Continued)

FOREIGN PATENT DOCUMENTS

DE 3510200 A1 * 9/1986 ..... A44C 17/04
EP 3 501 326 A1 6/2019

(Continued)

OTHER PUBLICATIONS

European Search Report dated Jun. 9, 2020 in corresponding European Patent Application No. 19 21 4649.6 (with English translation) (9 pages).

*Primary Examiner* — Jack W Lavinder
(74) *Attorney, Agent, or Firm* — Oblon, McClelland, Maier & Neustadt, L.L.P.

(57) ABSTRACT

A setting or mounting includes a ring carrying elements for setting a decorative element, this setting or mounting being arranged to be placed radially inside a hollow provided in a substrate of an item to be decorated. The setting includes a circular slot arranged to receive a ring-like element made of a shape memory alloy which can undergo a reversible transformation. The ring-like element is able to move from a retracted position in which it rests in the slot, to an open position in which the ring-like element at least partially protrudes from the slot to hold the setting in the substrate.

9 Claims, 3 Drawing Sheets

(56) References Cited

U.S. PATENT DOCUMENTS

| | | | | |
|---|---|---|---|---|
| 2018/0042344 | A1* | 2/2018 | Douglas | A44C 15/005 |
| 2019/0191832 | A1 | 6/2019 | Uldry et al. | |

FOREIGN PATENT DOCUMENTS

| | | | | |
|---|---|---|---|---|
| FR | 2 662 058 | A1 | 11/1991 | |
| FR | 2667486 | A1 * | 4/1992 | A44C 17/0216 |
| FR | 2 680 954 | A1 | 3/1993 | |
| FR | 2825590 | A1 * | 12/2002 | A44C 17/02 |

* cited by examiner

DECORATIVE ELEMENT MADE BY A SETTING TECHNIQUE

CROSS-REFERENCE TO RELATED APPLICATION

The present application claims priority to European Patent Application No. 19214649.6, filed on Dec. 10, 2019, the entire content and disclosure of which are incorporated by reference herein.

FIELD OF THE INVENTION

The present invention concerns a setting or mounting allowing a decorative element to be set in a decorative assembly.

BACKGROUND OF THE INVENTION

There are known, in the prior art, decorative pieces intended to be placed on a portable object, such as a watch or piece of jewellery, and in which aesthetic elements are set on the parts of said portable object serving as support.

For this purpose, the support is made of a metal alloy and is machined so that housings appear. During this machining, gripping means taking the form of hooks, more commonly called prongs or grains, are made. Generally speaking, these prongs or grains are made integral with the material forming the portable object, i.e. in one piece with the object. When an aesthetic element, such as a gemstone, needs to be set, the latter is placed inside a housing and the prongs are folded down by plastic deformation so as to hold said aesthetic element inside the housing. This setting method is widely used for setting gemstones on metal supports since the metal has an advantageous plastic deformation capacity. Cold plastic deformation of crystalline metals and their alloys is made possible by the movements of the lattice dislocations present in the crystal lattices. The elastic limit, i.e. the stress beyond which a material starts to deform plastically, of a crystalline alloy depends on its constituent elements and on the thermo-mechanical history of the alloy. For the conventional setting method, alloys having relatively low elastic limits are generally selected to facilitate the work of the setter. In addition to a relatively low elastic limit, it is necessary for the alloy to have sufficient elongation at break to be able to fold the prongs over without them breaking. As with the elastic limit, this elongation is the consequence both of the elements present in the alloy and of the thermo-mechanical history of the latter. For example, gold alloys used in horology have an elastic limit on the order of 200-400 MPa and an elongation at break of 20-40%. 1.4435 type stainless steels have an elastic limit of 200-300 MPa and an elongation at break of 25-45%.

Nevertheless, one drawback of this method is that it is limited to supports made of ductile metals or metal alloys. However, timepieces are increasingly made of materials with no plastic deformation, which are often hard and/or brittle, such as for example, ceramics, silicon, sapphire, intermetallic alloys, or metal, natural or polymer matrix composites.

Consequently, it is no longer possible to use the conventional method for setting aesthetic elements, such as for example, gemstones.

This setting operation is therefore generally replaced by an adhesive bonding operation. The drawback of adhesive bonding is that it cannot ensure 100% retention of the stones since, unlike setting, this technique does not entail any mechanical retention of the stones. Indeed, because the bonded areas are in most cases exposed to the external environment (humidity, sweat, UV, air pollution, . . . ) this makes it difficult for the bond to achieve long-term durability. Consequently, the adhesion of the stones is not guaranteed, which is unacceptable for high quality products.

European Patent Application No EP2796297 describes a solution to this problem by using an intermediate material between the non-deformable support and the decorative element. In this document, a cavity is made in the support, said cavity is then filled with a ductile material making it possible to set the decorative element. Filling the cavity requires the use of hot forming processes, such as casting, thermoforming, hot press fit or densification of a metal powder. This type of method thus induces thermal stresses, which are complex to control, and a specific tool.

U.S. Pat. No. 9,402,450 describes a setting including non-deformable claws that fit inside grooves provided in a gemstone, with the base of the setting being inserted into a hole in a support piece. In this document, plastic deformation of the base of the setting or of the support piece makes it possible to secure the setting to the support according to a principle similar to riveting. This plastic deformation is accompanied by a tightening of the claws, improving the stability of the setting. One drawback of this setting is that the stone must be pre-mounted. Further, this device is not suitable for insertion into a brittle material and does not allow settings or mountings to be interlinked, since the rivet holes are necessarily separated in order to properly secure the elements. Finally, it is indispensable to access the setting from the back for permanent assembly inside the support, which makes this setting unsuitable for blind holes, which are however indispensable in the case, for example, of a watch case.

SUMMARY OF THE INVENTION

It is an object of the present invention to overcome all or part of the aforecited drawbacks by providing a setting that is easy and quick to set in place.

It is also an object of the invention, at least in one particular embodiment, to provide a setting that can be assembled and disassembled at will without impairing its properties and its mechanical strength in a support.

To this end, the invention concerns a setting or mounting comprising a ring carrying elements for setting decorative elements, said setting or mounting being arranged to be placed radially inside a hollow provided in a substrate of an item to be decorated.

According to the invention, the setting comprises a circular slot arranged to receive a ring-like element made of a shape memory alloy which can undergo a reversible transformation, said ring-like element being able to move from a retracted position in which it rests in said slot, to an open position in which said ring-like element at least partially protrudes from said slot to hold the setting in the substrate.

According to other advantageous variants of the invention:

- the hollow has a slight taper, the surface of a cross section of the hollow increasing slightly with depth and forming a slope, to allow the deformation of the ring-like element;
- the ring-like element takes the form of a star with eight rounded points;
- the ring-like element is made of an alloy of nickel and titanium;

the setting elements are plastically deformable to be able to set the decorative element;

the setting has a base arranged to rest against the bottom of the hollow, the circular slot being arranged in proximity to the base of the setting.

The invention also concerns a decorative assembly comprising a setting or mounting, and a decorated article comprising a decorative assembly.

BRIEF DESCRIPTION OF THE DRAWINGS

Other features and advantages of the present invention will appear more clearly from the following detailed description of an example embodiment of a decoration element made by a setting technique according to the invention, this example being given solely by way of non-limiting illustration with reference to the annexed drawing, in which.

DETAILED DESCRIPTION OF THE INVENTION

The present invention concerns a setting 1 for retaining a decorative element, such as a gemstone 10, in a substrate 9 that does not have sufficient plastic deformation for a conventional setting technique. This generally concerns hard and brittle materials such as ceramic, silicon, sapphire, intermetallic alloys, or metal, natural or polymer matrix composites.

Figure 1:
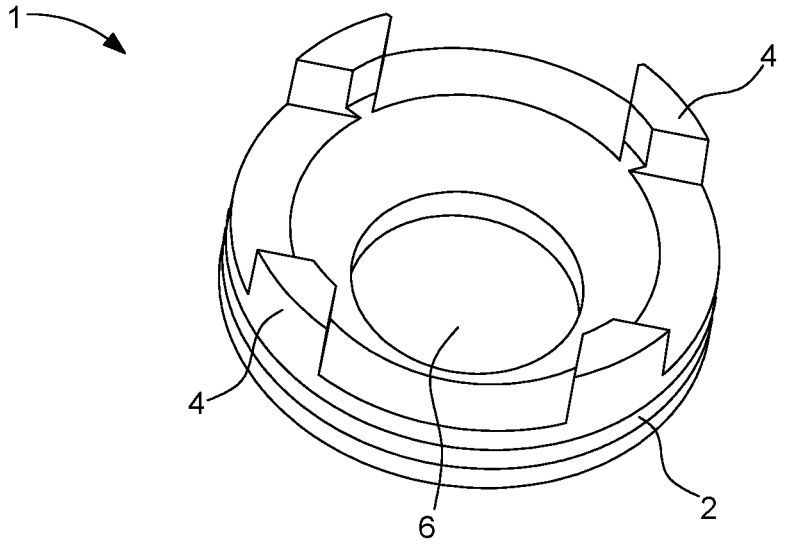
FIG. 1 represents an example of a setting according to the invention.
Figure 2:
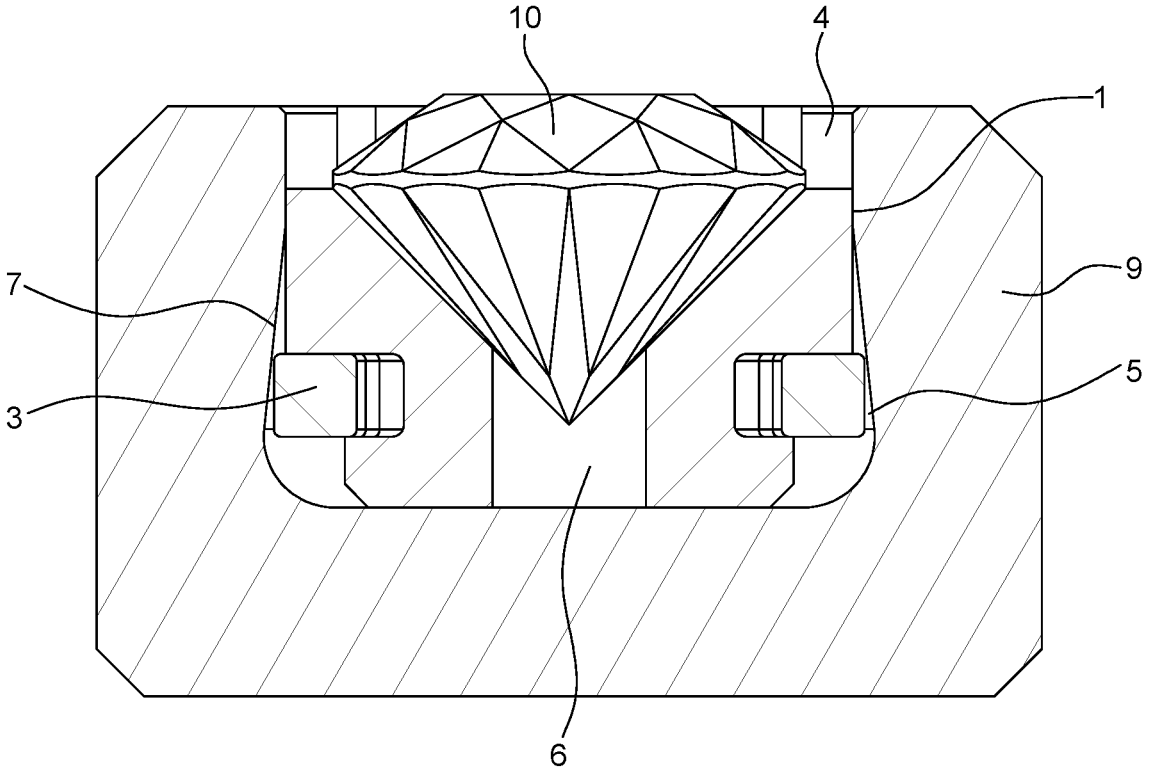
FIG. 2 represents a schematic sectional view of a setting of the invention in a support.

According to the invention, an intermediate setting 1 is inserted into a hollow 6 provided in substrate 9. As represented in FIGS. 1 and 2, this setting 1 essentially comprises a ring having a circular slot 2 in which a shape memory ring-like element 3 rests, circular slot 2 being arranged in immediate proximity to the base of setting 1.

It is known that shape memory alloys have the property of being able to undergo a reversible transformation from a high temperature 'austenitic' crystallographic phase to a low temperature 'martensitic' crystallographic phase, and can thus be trained, in certain temperature conditions, to adopt configurations corresponding to memory states. In particular, if an object made of such an alloy is trained to memorize a determined configuration in its austenitic phase, and this object is subsequently deformed while it is in its martensitic state, it remains in its deformed configuration. If this object is then heated and brought to a temperature at which it is in its austenitic phase, it tends to return to its non-deformed configuration, i.e. the configuration corresponding to its memory state.

Thus, by using these properties, it is possible to secure the setting in a simple manner by means of a ring-like element made of shape memory alloy. The use of a ring-like element made of shape memory alloy to secure the setting in a hollow makes it possible to assemble (tighten) and to disassemble (loosen) the setting in its hollow many times without damaging it simply by heating or cooling the ring-like element. The alloy used to make the ring-like element is a nickel/titanium alloy known by the name of Nitinol.

Thus, when the ring-like element is heated, the latter retracts and allows setting 1 to be inserted into hollow 5. Cooling the ring-like element after insertion into hollow 5 then secures setting 1 free of play in substrate 9.

The central portion of setting 1 includes a cavity 6 able to accommodate a decorative element 10 such as a gemstone.

The upper portion of setting 1 includes plastically deformable setting elements 4 for setting decorative element 10.

The walls of the hollow are preferably perpendicular to the surface of substrate 9, forming a straight cylinder of any cross-section, setting 1 being held by the friction forces generated by the pressure applied by the ring-like element on the walls of the hollow.

In an advantageous manner, hollow 5 has a slight taper, the surface of a cross section of the hollow increasing slightly with depth, the hollow then having a slightly inclined wall 7 in order to increase the space between setting 1 and inclined wall 7 of hollow 5 and to allow easier deformation of ring-like element 3 and more efficient mechanical anchoring of setting 1.

The material forming setting 1 must be sufficiently ductile to allow the plastic deformation required to set decorative element 10. This material includes gold, platinum, palladium, rhenium, ruthenium, rhodium, silver, iridium, osmium, or an alloy containing at least one of these elements.

According to the invention, ring-like element 3 takes the form of a star comprising eight rounded points 30. This geometry ensures better deformation of ring-like element 3 compared to an annular ring-like element, since ring-like element 3 according to the invention has a smaller cross section than an annular ring-like element.

Another advantage of such a geometry is that several points of contact 31 are obtained with wall 7 of hollow 5, which makes it possible to apply greater force to a smaller surface area and thereby ensure good retention. Those skilled in the art will have no particular difficulty in adapting the shape of the ring-like element to obtain similar effects, the number of rounded points of the star could be decreased or increased to obtain stars with five, six or nine rounded points, for example.

FIG. 2 represents a setting 1 inserted into a hollow 5 of a substrate 9. Setting 1 has a cylindrical shape whose lower diameter is slightly smaller than the diameter of the upper orifice of the hollow.

In the step of inserting setting 1 into hollow 5, the user pushes the setting into the hollow, which has the effect of placing the lower portion of the setting on the upper edges of the hollow.

The setting is in place once the latter is pushed to the bottom of the hollow. Ring-like element 3 is then heated so that it returns to its original shape and is pressed against inclined surface 7 of hollow 5. This deformation of the ring-like element provides excellent quality mechanical anchoring.

Figure 5:
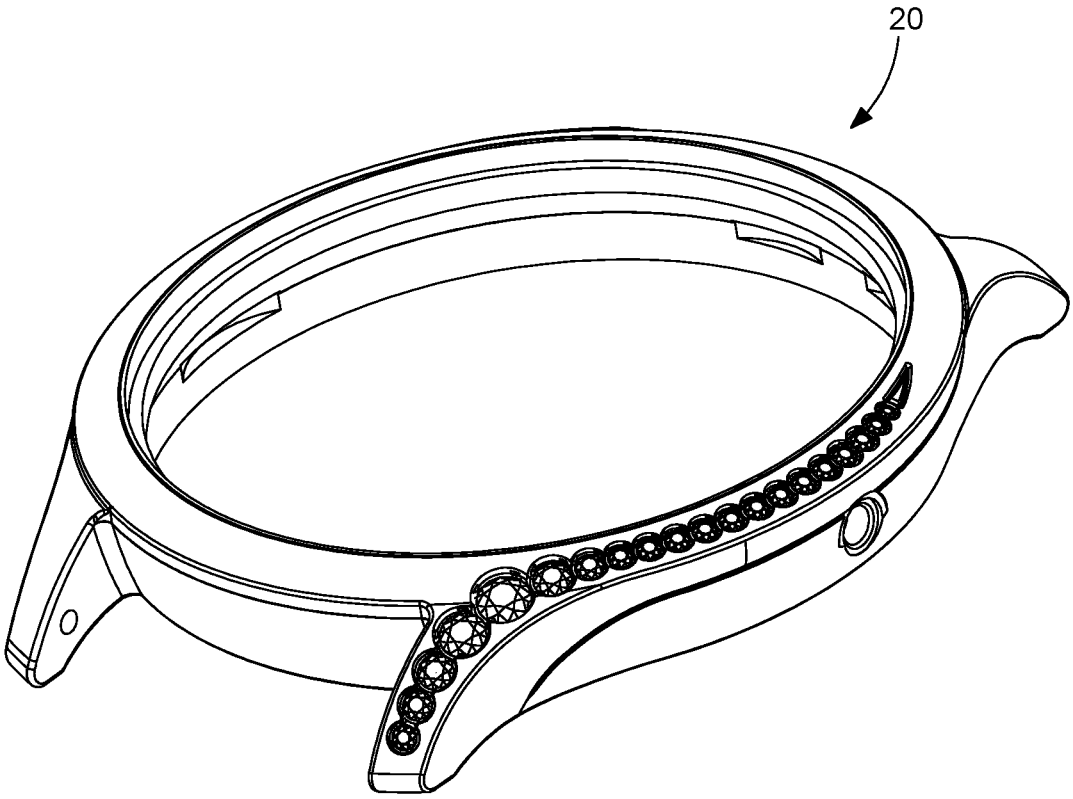
FIG. 5 represents an exploded view of a support, a setting and a decorative assembly.

FIG. 5 shows the setting of FIG. 1 in which a decorative element 10 has been placed, this decorative element 10 then being set by the plastic deformation of setting elements 4 using a suitable setting tool.

Figure 3:
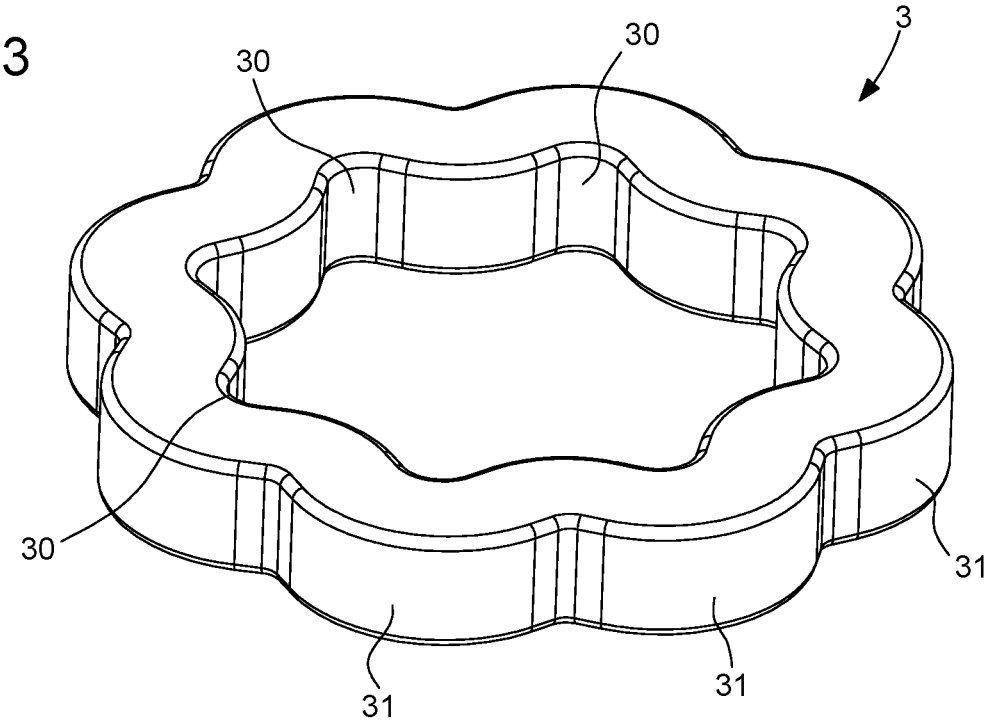
FIG. 3 illustrates a shape memory ring-like element according to the invention.

FIG. 3 shows a decorative part 20 in the form of a watch case comprising a plurality of settings inserted into a plurality of adjacent hollows.

Hollow 5 of substrate 9 can be made by any suitable means, such as machining, milling, laser ablation, or straight in the mould of the support. For example, in the case of a ceramic support, the hollow can be obtained by machining or laser ablation of the raw ceramic, the hollowed support being then fired and densified.

Figure 4:
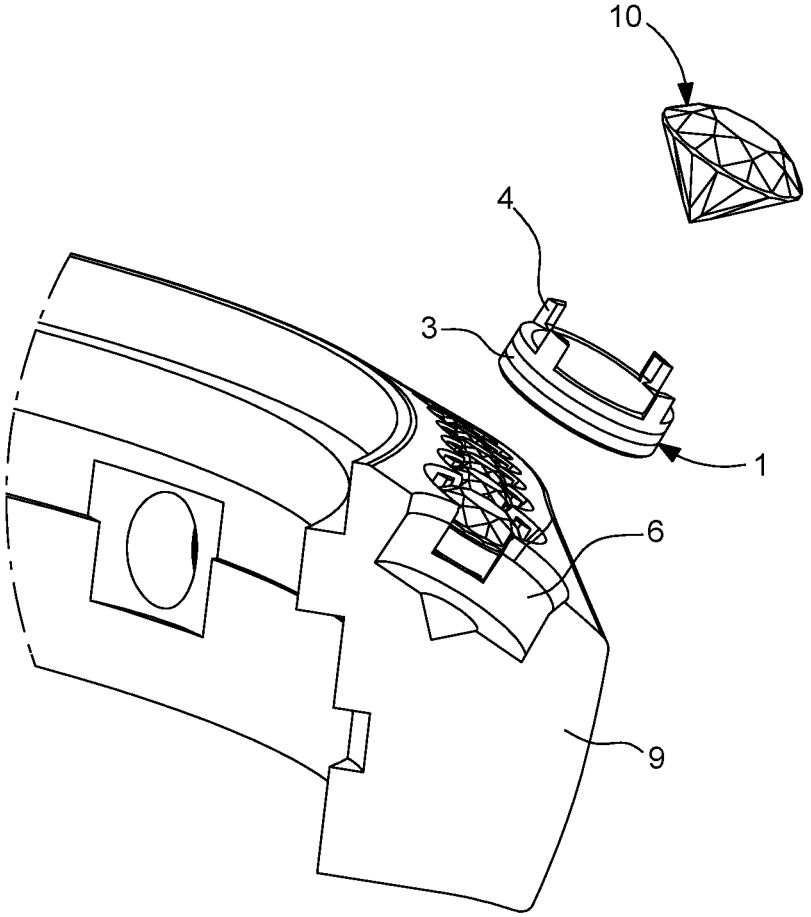
FIG. 4 represents a decorated article comprising a decorative assembly having several settings.

As seen in FIG. 4, setting 1 of the invention is particularly well suited for securing gemstones in blind holes and does not require access through the back of the support when the decorative element is secured. This feature is particularly advantageous when the decorative element is intended to be inserted into a solid or sealed device such as a watch case.

The invention claimed is:

1. A setting, comprising:

a ring carrying elements for setting a decorative element, said elements being positioned on an upper portion of the ring, said setting being arranged to be placed inside a hollow provided in a substrate of an item to be decorated; and a circular slot in a radially outer side of the ring, the circular slot being arranged to receive a ring-like element made of a shape memory alloy configured to undergo a reversible transformation, said ring-like element being configured to move from a retracted position, in which ring-like element rests in said circular slot, to an open position in which said ring-like element at least partially protrudes from said circular slot to apply pressure on walls of said hollow to hold the setting in the substrate.

2. The setting according to claim 1, wherein the hollow has a slight taper, a surface of a cross section of the hollow increasing slightly with depth and forming a slope, to allow the deformation of the ring-like element.

3. The setting according to claim 1, wherein the ring-like element takes the form of a star with eight rounded points.

4. The setting according to claim 1, wherein said ring-like element is made of an alloy of nickel and titanium.

5. The setting according to claim 1, wherein the setting elements are plastically deformable in order to be able to set the decorative element.

6. The setting according to claim 1, wherein the setting has a base arranged to rest against a bottom of the hollow, the circular slot being arranged in proximity to a base of the setting.

7. A decorative assembly comprising:

the setting according to claim 1; and a support including the hollow and the setting is placed inside the hollow.

8. The decorative assembly according to claim 7, wherein the hollow is a blind hole.

9. A decorated item comprising:

the decorative assembly according to claim 7.

* * * * *